US012773021B2

(12) United States Patent
Desmeules

(10) Patent No.: US 12,773,021 B2
(45) Date of Patent: Oct. 27, 2026

(54) ELECTRICALLY HEATING SECTIONAL PANEL STRUCTURE FOR HEATED WEARABLES

(71) Applicant: Brooke Erin DeSantis, Montreal (CA)

(72) Inventor: Alain Desmeules, Montreal (CA)

(73) Assignee: Desantis Brooke, Montreal (CA)

( * ) Notice: Subject to any disclaimer, the term of this patent is extended or adjusted under 35 U.S.C. 154(b) by 858 days.

(21) Appl. No.: 18/106,528

(22) Filed: Feb. 7, 2023

(65) Prior Publication Data

US 2024/0260686 A1 Aug. 8, 2024

(51) Int. Cl.

| | |
|---|---|
| ***A41D 13/005*** | (2006.01) |
| ***A41D 1/00*** | (2018.01) |
| ***A41D 1/02*** | (2006.01) |
| ***A41D 1/04*** | (2006.01) |
| ***A41D 31/08*** | (2019.01) |
| ***A41D 31/102*** | (2019.01) |
| ***A41D 31/12*** | (2019.01) |
| ***A41D 31/14*** | (2019.01) |
| ***A41D 31/26*** | (2019.01) |
| ***A41D 31/30*** | (2019.01) |

(52) U.S. Cl.

CPC ..... *A41D 13/0051* (2013.01); *A41D 1/005* (2013.01); *A41D 1/02* (2013.01); *A41D 1/04* (2013.01); *A41D 31/085* (2019.02); *A41D 31/102* (2019.02); *A41D 31/12* (2019.02); *A41D 31/145* (2019.02); *A41D 31/26* (2019.02); *A41D 31/30* (2019.02); *A41D 2400/12* (2013.01)

(58) Field of Classification Search

CPC ..... A41D 31/12; A41D 1/04; A41D 13/0051; A41D 31/145; A41D 31/126; A41D 1/02

See application file for complete search history.

(56) References Cited

U.S. PATENT DOCUMENTS

| | | | | |
|---|---|---|---|---|
| 2020/0404987 | A1 * | 12/2020 | Betkowski | A41D 1/005 |
| 2022/0160540 | A1 * | 5/2022 | Wang | A61F 7/08 |
| 2022/0287394 | A1 * | 9/2022 | Elliff | A41D 7/003 |

FOREIGN PATENT DOCUMENTS

| | | | | |
|---|---|---|---|---|
| CN | 104687459 A | * | 6/2015 | A41D 31/08 |
| CN | 209126565 U | * | 7/2019 | |
| CN | 211241808 U | * | 8/2020 | |
| CN | 213756746 U | * | 7/2021 | |
| JP | H1112369 A | * | 1/1999 | |
| KR | 20170006021 A | * | 1/2017 | B63C 9/11 |
| KR | 101974314 B1 | * | 4/2019 | H05B 3/54 |

* cited by examiner

*Primary Examiner* — Thien S Tran

(74) *Attorney, Agent, or Firm* — Brouillette Legal Inc.; Robert Brouillette; Guy Houle

(57) ABSTRACT

A heating panel structure for heated wearables is constructed with a power leads connection section and a breathable heating wire section. The power leads connection section contains at least electrically shielded power leads connections to heating wires disposed in a pattern in the breathable heating wire section. The power leads connection section is formed of selected fabrics interconnected together to form an air-tight non-breathable fireproof and waterproof impermeable enclosure for the power leads connections. The breathable heating wire section is formed with a lamination of breathable fabric sheets, between which a pattern of the heating wire is secured, and which provides moisture wicking and shedding for the comfort of a wearer person.

12 Claims, 2 Drawing Sheets

ELECTRICALLY HEATING SECTIONAL PANEL STRUCTURE FOR HEATED WEARABLES

FIELD OF INVENTION

The present invention relates to heating panels for use in heated wearables and more particularly to the construction of a heating panel wherein the power leads connection to the heating wires are isolated in an air-tight non-breathable, fireproof and waterproof impermeable section of the heating panel and the body heating section of the panel is constructed as a breathable section.

BACKGROUND OF THE INVENTION

In recent years, the popularity of heated wearables has led to advancements in the development of more powerful portable batteries for use with such heated wearables to extend their heating time. This added electrical power has also led to the construction of heating panels of larger sizes to cover a larger surface area of a person's body and eliminating the need for multiple smaller panels which made it more difficult and time consuming for its installation in garments. The use of more powerful batteries also generates higher current in its power supply and therefore higher vulnerability to fire, particularly by the creation of electrical sparks at the juncture of the copper supply wires with the heating wires which are usually made of carbon, copper alloy or other suitable conductive materials to capable of generating heat when rendered electrical conductive. These juncture connections create hot spots in the fabrics which are vulnerable to fire, particularly when present in an enriched oxygen air environment. Accordingly, this created a need to provide for the construction of the heating panels providing better fireproof and waterproof protection using polymer coverings that provide a sealing environment for the electrical wiring supply connections with the heating wires as well as providing protection against water infiltration. The heating wires are formed of flexible wires, usually carbon fibers which are flexible and capable of being sewn into the panel polymer sheet material. Because the heating panels have also become larger, this has created other problems, of being non-breathable, less pliable and therefore uncomfortable to the user person because of its inability to conform to the wearer person's body and to wick and shed perspiration. This is particularly so for such garments which are utilized, for example, by construction workers, police and people engaged in sports activities during cold winter months and who generate a greater amount of sweat.

A solution to the above-mentioned problem would be to fabricate electrically heating panels with breathable fabric materials. However, when using such breathable fabrics, oxygen becomes present in the environment of the power wire connections to the heating wires and this increases the risk of fire caused by higher current flow throughout the wire connecting paths. Because of the above problems and risks, currently electrical heating panels utilize polyester fabrics in their construction wherein such panels are airtight, non-breathable and non-fire resistant. Because such electrical heating panels have become larger in size, they have also become less comfortable to the wearer person due to their inability to wick and shed perspiration.

There is therefore a need to provide electrically heated panels for use in heated wearables and capable of overcoming the above mentioned problems of current electrically heating panels.

BRIEF SUMMARY OF THE INVENTION

It is a feature of the present invention to provide an electrically heating panel structure for heated wearables and which overcomes the above mentioned problems and wherein the panel is constructed such as to be fireproof and breathable.

Another feature of the present invention is to provide an electrical heating panel structure for heated wearables which is constructed in two sections, one of which contains the power leads connections, and possibly various sensors and other electronic components, and which is fireproof and the other which contains the heating wires only and which is constructed with breathable fabric materials.

A further feature of the present invention is to provide an electrically heated panel for use in heated wearables comprising a small section of fireproof material for shielding the power leads connections to heating wire patterns disposed in a much larger panel section formed of breathable fabric materials.

According to the above features, from a broad aspect, the present invention provides a heating panel structure for heated wearables and constructed with a power leads connection section and a breathable heating wire section. The power leads connection section contains at least electrically shielded power leads connections to heating wires disposed in a pattern in the breathable heating wire section. The power leads connection section is formed of selected fabrics interconnected together to form an air-tight non-breathable fireproof and waterproof impermeable enclosure for the power leads connections. The breathable heating wire section is formed with a lamination of breathable fabric sheets, between which a pattern of the heating wire is secured, and which provides moisture wicking and shedding for the comfort of a wearer person.

According to a further broad aspect of the present invention there is provided an electrically heated wearable having at least one heating panel provided with a power leads connection section and a breathable heating wire section. The power leads connection section contains at least electrically shielded power leads connections to heating wires disposed in a pattern in the breathable heating wire section. The power leads connection section is formed of selected fabrics interconnected together to form an air-tight non-breathable, fireproof and waterproof impermeable enclosure for the power leads connections. The breathable heating wire section is formed of laminated breathable fabric sheets, between which the pattern of heating wire is disposed and secured, and which provides moisture wicking and shedding for the comfort of a wearer person.

BRIEF DESCRIPTION OF THE DRAWINGS

The invention will now be described, by way of example, with reference to the accompanying drawings in which.

DETAILED DESCRIPTION OF THE INVENTION

Before any embodiments of the application are explained in detail, it is to be understood that the application is not limited to the details of construction and the arrangement of component part set forth in the following description or illustrated by the drawings. Further, it is to be understood that the phraseology and terminology used herein is for the purpose of description and should not be regarded as limiting but should encompass equivalents thereof.

Figure 1:
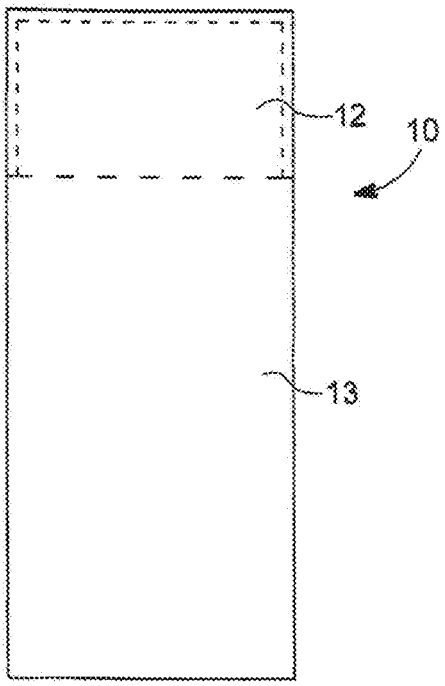
FIG. 1 is a plan view of the electrically heating panel of the present invention illustrating its construction comprising a power leads connection section and a breathable heating wire section.
Figure 2:
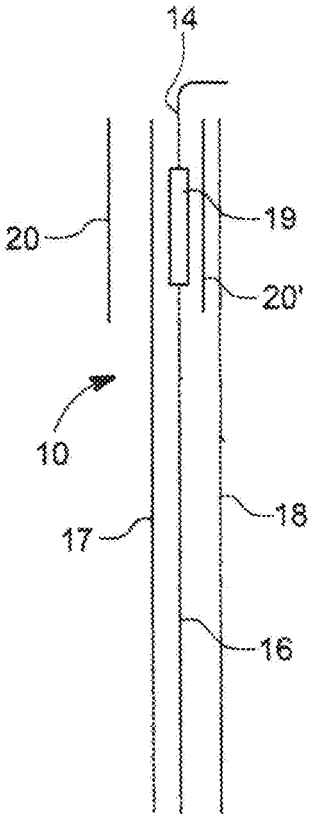
FIG. 2 is an exploded side view showing an example of the construction of the electrical heating panel of the present invention.
Figure 3:
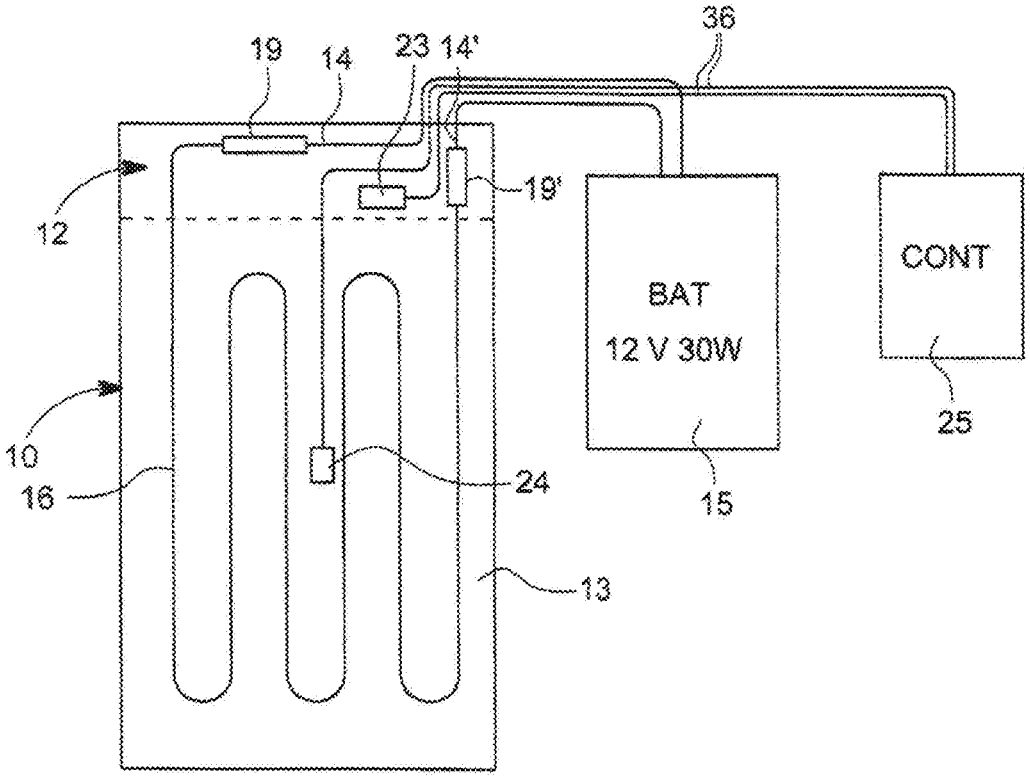
FIG. 3 is a plan view showing the layout of the connecting power leads to the carbon fiber heating wire in a top isolated section of the heating panel as well as temperature sensors embedded in the power leads connection section and the heating wire section to provide temperature signals to a controller.
Figure 5:
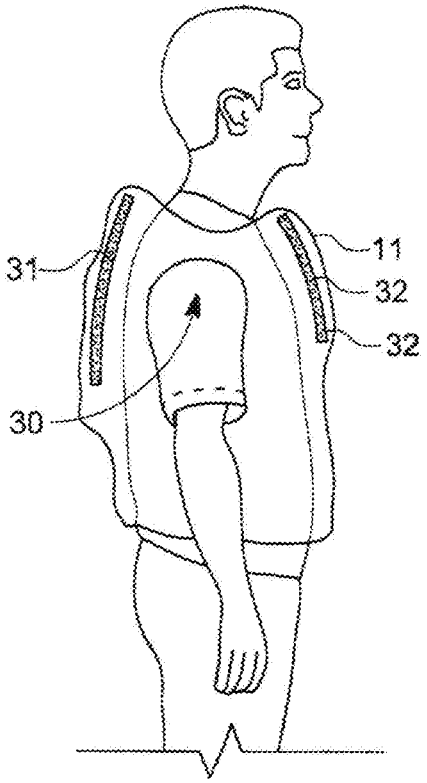
FIG. 5 is a simplified side view of a wearer person showing the position of the heating panels on the front and back of the wearer person.

Referring to the drawings and more particularly to FIGS. 1 to 3, there is shown generally at 10, the electrical heating panel structure of the present invention for use in heated wearables 11, as schematically depicted in FIG. 5. The heating panel structure 10 defines a power connection section 12 and a breathable heating wire section 13. The power connection section 12 contains electrically shielded power leads 14 and 14' from a battery supply 16, usually rated in the range of from about 3 to 20 volts do, generating power in the range of about 5 to 100 watts. The power leads 14 and 14' are connected to the heating wire(s) 16 retained in a zigzag pattern between a breathable body side fabric sheet 17 and an outer side fabric sheet 18. The heating wires 16 are usually constructed of carbon fiber wire or copper alloy or other suitable conductive flexible wire materials, as is well known in the art. The power connection section 12 isolates the power leads connections from the breathable heating wire section 13. The power leads connections to the heating wire 16 are electrically shielded by non-electrically conductive sleeves 19.

The power connection section 12 is an air-tight section formed with outer sheets 20 and 20' of fireproof, non-breathable fabric material, of types known in the art. These sheets 20 ands 20', are formed of aramid fibers but can also be formed with other materials which also have waterproof properties to form an impermeable enclosure. The breathable heating wire section 13, on the other hand, is formed of laminated breathable fabric sheets 17 and 18 providing moisture wicking and shedding for the comfort of a wearer person. Fleece materials are an example of such breathable fabrics, but not limited thereto, as several other fabrics may be used in its construction to provide the moisture shedding feature.

Figure 4:
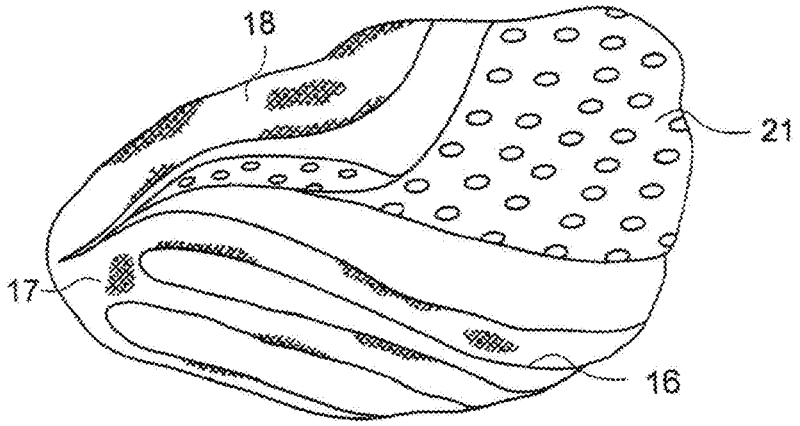
FIG. 4 is a fragmented view showing an example of the construction of the heating panel of the present invention using a perforated adhesive film as the bonding material between the inner and outer fabric sheets on one of which is secured the heating wire or wires.

FIG. 4 illustrates an example of the construction of the laminated breathable fabric sheets 17 and 18 wherein the sheets are shown bonded together by a perforated adhesive film 21 providing the bonding material between the sheets 17 and 18 with the heating wire 16 disposed and retained by stitching in a pattern on the inner surface of the fabric material sheet 17, As Illustrated in FIG. 1, the breathable heating wire section 13 has a surface area which is at least three times the surface area of the power connection section 12. FIG. 3 illustrates a power connection section 12 of much smaller size by orienting the power connections differently and preferably the breathing heating wire sections 13 may have a surface area up to about 90% of the total surface area of the heating panel structure. Also, as illustrated in FIG. 3, temperature sensors 23 and 24 may be held captive in each the power connection section 12 and the breathable heating wire section 13, to feed sensed temperature signals to a controller 25 associated with the electrical heating panel structure 10 to monitor and control the temperature of the heating panel 10.

As illustrated, the heating panel structure 10 is a rectangular shape heating panel with the power connection sections being formed in an uppermost portion of the rectangular shaped heating panel. Other panel configurations are also possible. The power connection section 12 and the breathable heating wire section 13 may also be treated with a coating of one of or a combination of anti-static solution, an anti-bacterial solution and antimicrobial solution or use fibers having these properties incorporated therein. Still further, the body facing fabric of the heating panel 10 and an outer fabric can have a different color with the body heating surface being of a reddish tone and said outer surface being of a blueish tone representative of heat and cold sides to facilitate its incorporation into wearable, such as vests, jackets, coats, pants, boots and other wearables where such panels may be integrated in all shapes and form for the comfort of the wearer person.

Figure 6:
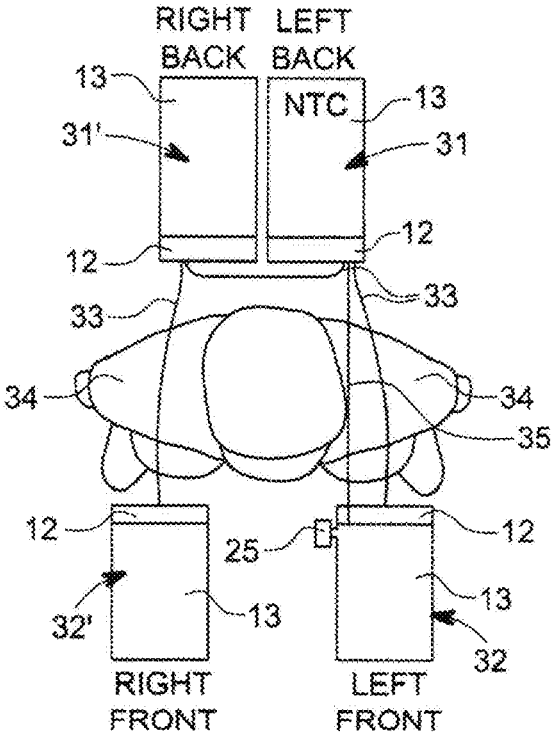
FIG. 6 is a top view of a wearer person showing and example of four interconnected heating panels positioned to be disposed over the back and front of the wearer person.

FIGS. 5 and 6 illustrate a wearer person 30 wearing a vest 11, but could be a jacket or coat, equipped with electrical heating panels, herein two back heating panels 31 ands 31', mounted in the back of the vest 11, and two frontal panels 32 and 32' secured in side portions of the vest 11. The travel paths of the electrically insulated power leads 33 is shown as extending over the shoulder region 34 of the wearer person and between the two back panels 31 and 31'. It also illustrates a cable 35 containing the wires 36 to the different heat sensors 23 and 24 associated with the panels and leading to the controller. All of this wiring is secured within the article of apparel, herein the vest 11.

It is pointed out that any modifications and other embodiments of the present invention as described above will come to mind to a person skilled in the art to which the invention pertains having the benefit of the teachings described herein above and the drawings. Hence, it is to be understood that the embodiments of the present invention are not to be limited to the specific examples thereof as described herein and other embodiments are intended to be included within the scope of the present invention and the appended claims. Although the foregoing descriptions and associated drawings describe example embodiments in the context of certain examples of the elements and members and/or functions, it should be understood that different combinations of elements or substitutes and/or functions may be provided by different embodiments without departing from the scope of the present invention as defined by the appended claims. Furthermore, although specific terms are employed herein, they are used in a generic and descriptive sense only and other equivalent terms are contemplated herein with respect to the items that they relate to. It is therefore within the ambit of the resent invention to encompass all obvious modifications of the examples of the preferred embodiment described herein provide such modifications fall within the scope of the appended claim

The invention claimed is:

1. An integrally formed electrical heating panel structure for heated wearables, said heated wearables being adapted to contain a portable dc battery supply, said integrally formed heating panel structure comprising a heating panel structure having a power connection section and a breathable heating elements section, said power connection section containing power leads for connection to said portable do battery, said power leads also being connected to input ends of heating elements disposed in a pattern in said breathable heating elements section; said input ends being electrically shielded by non-electrically conductive sleeves, said power connection section being formed of selected fabrics interconnected together to form an air-tight non-breathable, fireproof and waterproof impermeable enclosure for said power leads connections; said breathable heating elements section having laminated breathable fabric sheets between which a pattern of said heating elements is secured, said breathable heating elements section having moisture wicking and shedding properties to provide comfort to a wearer person.

2. The integrally formed electrical heating panel structure as claimed in claim 1 wherein said heating elements are formed of carbon fiber conductive wires, copper alloy wires or other suitable conductive heating elements materials, said laminated breathable fabric sheets being treated with a fire-retardant product solution.

3. The integrally formed electrical heating panel structure as claimed in claim 1 wherein said laminated breathable fabric sheets are bonded together by a perforated adhesive film with said pattern of said heating elements secured to an inner surface of one of said breathable fabric sheets.

4. The integrally formed electrical heating panel structure as claimed in claim 2 wherein said power connection section is formed by a lamination of fabrics containing aramid fibers.

5. The integrally formed electrical heating panel structure as claimed in claim 1 wherein said breathable heating elements section has a surface area which is at least three times larger than a surface area of said power connection section, and wherein there is further provided a temperature sensor held captive in each said power leads connection section and said breathable heating elements section to feed sensed temperature signals to a controller associated with said electrical heating panel structure.

6. The integrally formed electrical heating panel structure as claimed in claim 1 wherein said power leads are formed of copper wires, said power leads being connected to a portable battery supply having a rating of from about 3 to 20 volts do generating power in the range of from about 5 to 100 watts.

7. The integrally formed electrical heating panel structure as claimed in claim 1 wherein said heating panel structure is a rectangular shape heating panel, said power connection section being formed in an uppermost portion of said rectangular shaped heating panel.

8. The integrally formed electrical heating panel structure as claimed in claim 3 wherein said power connection sections and said breathable heating wire section are treated with a coating of one of or a combination of an anti-static product solution, an anti-bacterial product solution and antimicrobial product solution.

9. The integrally formed electrical heating panel structure as claimed in claim 3 wherein an outer one of said laminated breathable fabric sheets is a fleece material sheet.

10. The integrally formed electrical heating panel structure as claimed in claim 1 wherein said heating panel structure defines an inner surface and an outer surface, said inner surface having a color representative of a body heating surface, said outer surface having a color representative of a cooler outer surface whereby to facilitate the securement of said electrical heating panel in heated wearables.

11. The integrally formed electrically heated wearable as claimed in claim 1 wherein said electrically heated wearable is a body heating wearable having a rear fabric panel and opposed frontal right and left side fabric panels, there being two of said heating panel structures retained side-by-side in said rear fabric panel and one of said heating panel structure in each said opposed right and left front fabric panels.

12. The integrally formed electrically heated wearable as claimed in claim 1 wherein said heated wearable is a body covering wearable which is one of a jacket, vest and coat.

* * * * *